US008276295B2

(12) United States Patent
Shiao

(10) Patent No.: US 8,276,295 B2
(45) Date of Patent: Oct. 2, 2012

(54) MIDSOLE WITH THREE-DIMENSIONAL WEAR-RESISTANT COMPONENT AND THE METHOD FOR MANUFACTURING IT

(75) Inventor: Jui Fen Shiao, Taichung County (TW)

(73) Assignee: Dah Lih Puh Co., Ltd, Taichung County (TW)

( * ) Notice: Subject to any disclaimer, the term of this patent is extended or adjusted under 35 U.S.C. 154(b) by 459 days.

(21) Appl. No.: 12/693,859

(22) Filed: Jan. 26, 2010

(65) Prior Publication Data

US 2011/0179678 A1 Jul. 28, 2011

(51) Int. Cl.
*A43B 13/00* (2006.01)

(52) U.S. Cl. ..... 36/25 R; 36/31; 36/17 R; 36/136; 12/146 B

(58) Field of Classification Search ..... 36/31, 17 R, 36/17 PW, 136, 25 R, 103, 112; 12/146 B, 12/146 W, 142 D
See application file for complete search history.

(56) References Cited

U.S. PATENT DOCUMENTS 3,217,345 A * 11/1965 Snitzer ..... 12/142 R
4,026,044 A * 5/1977 Senter ..... 36/14
4,050,167 A * 9/1977 Senter ..... 36/32 R
4,551,930 A 11/1985 Graham et al.
4,561,140 A 12/1985 Graham et al.
4,654,983 A 4/1987 Graham et al.
4,730,402 A 3/1988 Norton et al.
4,759,136 A * 7/1988 Stewart et al. ..... 36/114
4,876,053 A 10/1989 Norton et al.
5,755,045 A * 5/1998 Mashita et al. ..... 36/84
6,438,873 B1 * 8/2002 Gebhard et al. ..... 36/114
6,957,504 B2 * 10/2005 Morris ..... 36/136
2002/0178612 A1 * 12/2002 Tsen et al. ..... 36/14
2009/0013558 A1 * 1/2009 Hazenberg et al. ..... 36/88
2010/0107446 A1 * 5/2010 Peet ..... 36/100

* cited by examiner

*Primary Examiner* — Marie Patterson
(74) *Attorney, Agent, or Firm* — Morris, Manning & Martin, LLP; Tim Tingkang Xia, Esq.

(57) ABSTRACT

The present invention provides a midsole with a main body and a peripheral component having foam material filled inside, precise ornamental details and wear-resistant outer shell. According to the present invention, a preferred method of manufacturing a midsole with less weight than traditional and high resolution pattern is provided with the steps of: forming a TPU thin sheet into a shell with three-dimensional ornamental details and a receiving space, filling a foam material into the receiving space thereby to enhance the strength of the shell, trimming the shell together with the filled foam material from the thin sheet to be a peripheral component of the present invention, forming a main body of the midsole by foam material, and bonding the peripheral component to the main body of the midsole.

10 Claims, 3 Drawing Sheets

MIDSOLE WITH THREE-DIMENSIONAL WEAR-RESISTANT COMPONENT AND THE METHOD FOR MANUFACTURING IT

BACKGROUND OF THE INVENTION

1. Field of the Invention

The present invention relates to a midsole and the method for manufacturing it. More particularly, the present invention relates to a method and a midsole which has three dimensional peripheral component having a shell filled with foam material and providing wear-resistant surface with precise ornamental details.

2. Description of the Related Art

Midsoles for athletic shoes have been characterized as the most important part of footwear. This portion of the shoe is the interface between the foot of the wearer and the ground. The rather significant force at which the foot of a runner strikes the ground, especially at the toe and heel portions, is transmitted through the body of runner. The force developed is absorbed in significant part by the midsole.

The increase in demand for shoes for sports and outdoor activities such as walking, running, hiking, tennis, basketball and numerous other high activity sports have prompted many advances in shoe design to provide improved protection and comfort to the feet, ankles, legs, hips, etc. Efforts to improve shoes have entered on decreasing shoe weight and improving cushioning, flexibility, and stability.

The midsole contributes to foot stability and is the primary shock absorption member of the sole. The midsole is composed generally of a softer, more flexible material than the outsole. Since the midsole is important to such factors as stability and shock absorption, the design of the midsole has received considerable attention by sport shoe manufacturers.

A foam midsole material by itself is generally inadequate to provide the stability and cushioning demanded for modern sport shoes. The foams used in current soles have insufficient external surface tension by themselves to provide the required stabilizing forces in response to pressures exerted on a sole.

Several molding process for fabricate a midsole are described in U.S. Pat. Nos. 4,730,402 and 4,876,053, both of which are issued to Norton et al. and both of which are hereby incorporated by reference. Furthermore, the process of molding EVA with polyurethane is also disclosed in U.S. Pat. Nos. 4,551,930, 4,561,140, and 4,654,983, all issued to Graham et al. and all of which are hereby incorporated by reference.

While there are advantages gained by compression molding a plastic material, e.g. extending the life of the material, there are attendant disadvantages of such compressive forces. In particular, the compressive force is substantially parallel to the inner surface of the sidewall of the mold. Consequently, the outer surface of the performed receives very little lateral compressive forces. Instead, the outer surface of the preform aligned along the inner surface of the mold receives mostly vertically directed compressive forces. Consequently, it is very difficult to obtain ornamental details on the sidewalls of the midsole which have a high resolution.

In order to develop fine details on the outer surface of the midsole, it is necessary to apply the compressive forces in a direction which is aligned substantially perpendicular with respect to the peripheral surface of the midsole.

SUMMARY OF THE INVENTION

To achieve its intended purposes, objects and advantages over the prior art, the present invention provides a midsole with a main body and a peripheral component having foam material filled inside, precise ornamental details and wear-resistant outer shell.

According to the present invention, a preferred method of manufacturing a midsole with less weight than traditional and high resolution pattern includes the steps of: forming a TPU thin sheet into a shell with three-dimensional ornamental details and a receiving space, filling a foam material into the receiving space thereby to enhance the strength of the shell, forming a main body of the midsole by foam material, bonding the shell together with the filled foam material to the main body of the midsole.

These and other features and advantages of the present invention will become apparent from the following detailed description, wherein reference is made to the figures in the accompanying drawings.

DETAILED DESCRIPTION OF THE PREFERRED EMBODIMENTS

Figure 1:
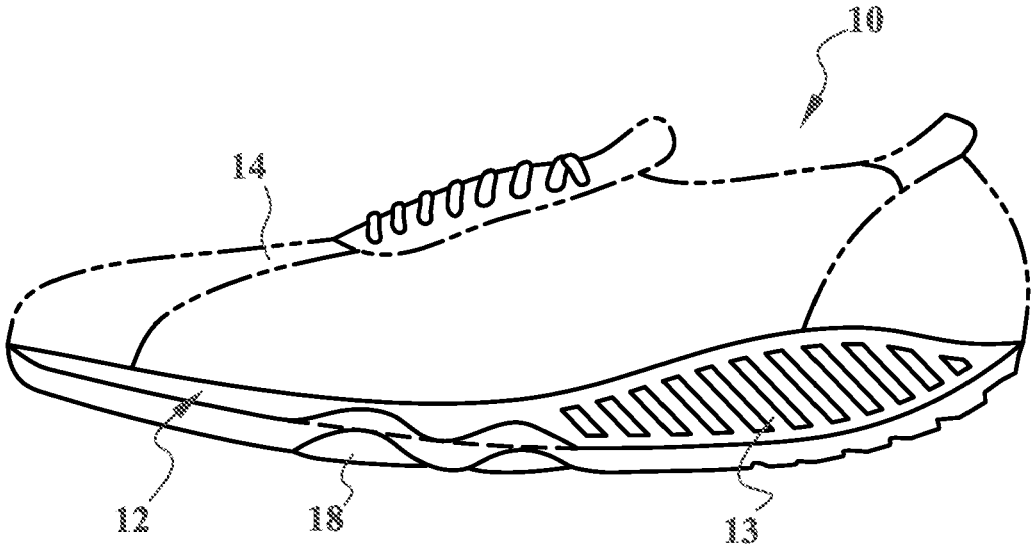
FIG. 1 is a perspective view of a midsole mounted in a shoe, wherein the midsole is covered with a three-dimensional wear-resistant component according to the present invention.

Referring to the drawings, wherein like numerals indicate like elements, there is shown in FIG. 1 an shoe 10 with a midsole 12 manufactured according to the present invention. An upper 14 shown in phantom is secured to the midsole 12. The midsole 22 has a peripheral component 13 provided with variety of ornamental features on its outer surface. An outsole 18 is secured to the bottom surface of the midsole 12, and typically has a tread configuration designed for a particular application.

Figure 6:
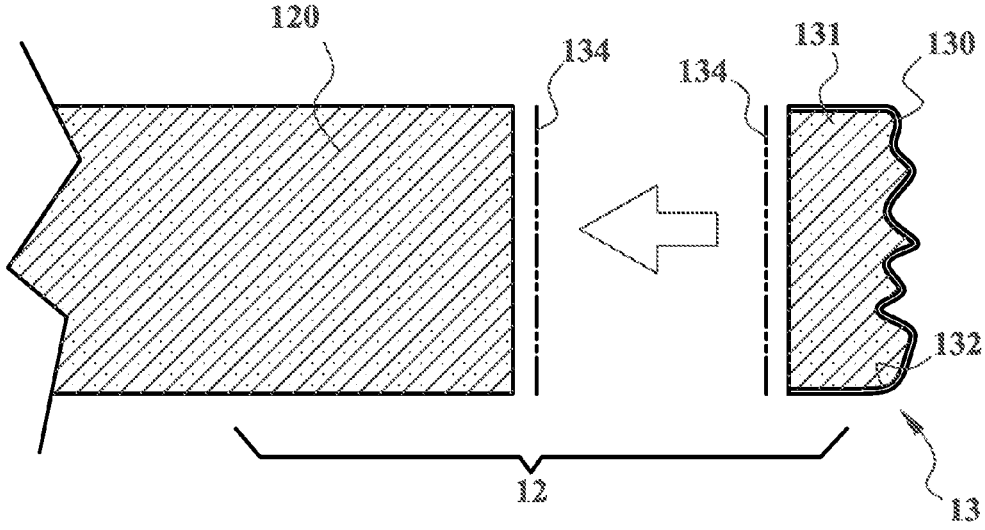
FIG. 6 is a perspective view of the shell of three-dimensional wear-resistant component bonding to a foam main body of a midsole by glue.

With reference to FIG. 6 in conjunction with FIG. 1, there is shown a partial cross section of the midsole 12 manufacturing according to the preferred embodiment. The midsole 12 includes a main body 120 made of foam material and a peripheral component 13 having a three dimensional shell 130 filled with foam material 131. The peripheral component 13 is finally bonded to the main body 120 by applying an adhesive layer 134 therebetween.

The foam material 131 can be of Poly Urethane (PU) and preferably directly poured into formed in the receiving space 132 so as to combined integrally with the shell.

The shell 130 can be made of wear-resistant material, such as thermoplastic polyurethane (TPU) or ethylene vinyl acetate (EVA), formed with a receiving space 132 for receiving the foam material 131 to enhance the strength against compression of the shell.

Figure 2:
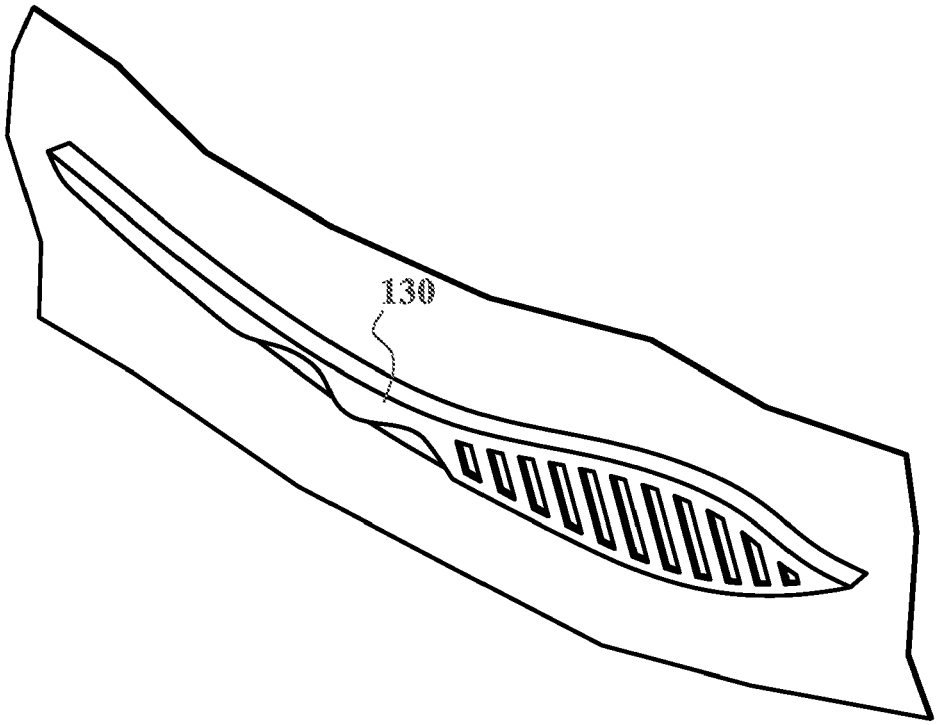
FIG. 2 is a perspective view of a shell of three-dimensional wear-resistant component formed in step one, from a TPU thin sheet by a thermal-forming equipment.
Figure 3:
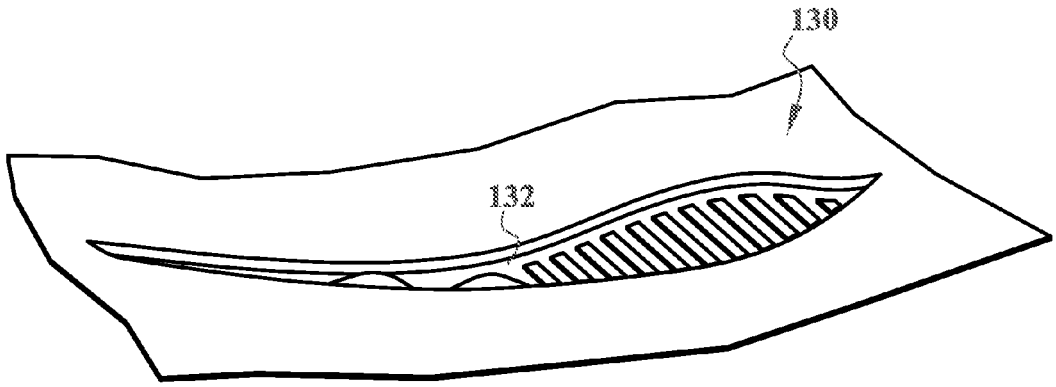
FIG. 3 is another perspective view of the shell of three-dimensional wear-resistant component formed in step one, showing a receiving space for receiving a foam material.
Figure 4:
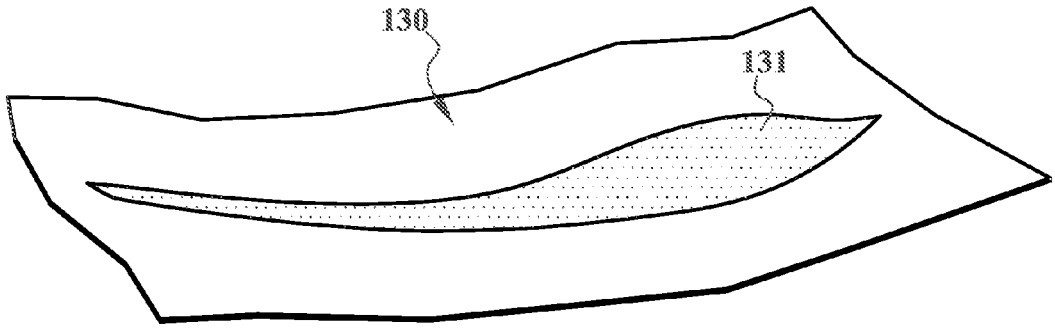
FIG. 4 is a perspective view of the shell of three-dimensional wear-resistant component formed in step one, showing the receiving space filled with a foam material to support and enhance the strength of the shell.
Figure 5:
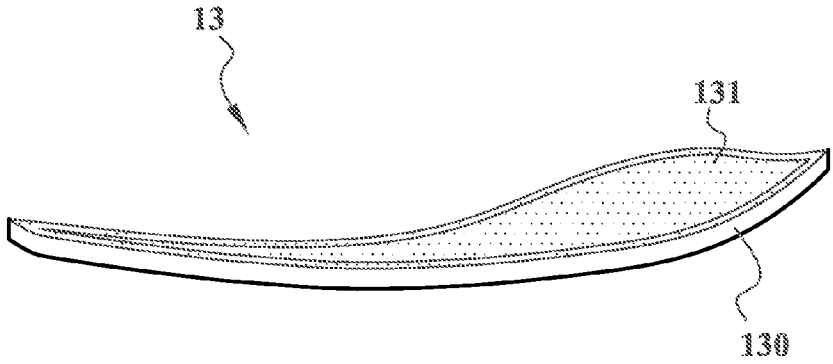
FIG. 5 is a perspective view of the shell of three-dimensional wear-resistant component being cut off from the TPU thin sheet.

According to the present invention, a preferred method of manufacturing a midsole 12 with less weight than the traditional and high resolution pattern on the peripheral, includes the steps of: thermal-forming a TPU or EVA thin sheet into a shell 130 as shown in FIGS. 2 and 3 with three-dimensional ornamental details and a receiving space 132, filling a foam material 131 into the receiving space 132 as the result shown in FIG. 4 thereby to enhance the strength against compression of the shell 130 therein, trimming the shell 130 off from the TPU or EVA thin sheet to be a peripheral component 13 of the present invention as the result shown in FIG. 5, forming a main body of the midsole 12 from foam material (partially shown in FIG. 6), and bonding the peripheral component 13 to the main body 120 of the midsole 12.

The thermal-forming step may be embodied by clamping the TPU or EVA thin sheet between a metal molding tool, heated to 70-80° C. for 2 minutes, and then chilled to a room temperature between 10-30° C.

The main body 120 and the foam material 131 may be made from an open cell foam material such as polyurethane (PU). As the open cell foam materials are structurally formed of an open network of cells similar to a sponge which might undesirably absorb water, the shell 130 and the adhesive layer 134 might both provide the effect of water resistant to the main body 120.

All of the U.S. patents mentioned in the Background of the Invention are hereby incorporated by reference.

This invention has been described in detail with respect to the preferred embodiments. These embodiments, however, are merely for example only and this invention is not intended to be restricted thereto. It will be easily understood by those skilled in the art that variations and modifications can be easily made within the scope of the invention, as defined by the appended claims.

What is claimed is:

1. A midsole with three-dimensional wear-resistant component, comprising:

a main body made from a foam material; and a peripheral component having a shell made from a thin sheet by thermal-forming formed with a receiving space and filled with a foam material therein for enhance a strength against compression of the shell.

2. The midsole with three-dimensional wear-resistant component in accordance with claim 1, wherein the thin sheet is made from TPU.

3. The midsole with three-dimensional wear-resistant component in accordance with claim 1, wherein the thin sheet is made from EVA.

4. The midsole with three-dimensional wear-resistant component in accordance with claim 1, wherein the shell is formed with a precise ornamental details.

5. The midsole with three-dimensional wear-resistant component in accordance with claim 1, wherein the foam material is directly formed in the receiving space thereby combined integrally with the shell.

6. A method for manufacturing a midsole, comprising steps of:

thermal-forming a thin sheet into a shell with three-dimensional ornamental details and a receiving space;

filling a foam material into the receiving space thereby to enhance the strength against compression of the shell therein;

trimming the shell off from the thin sheet to be a peripheral component;

forming a main body of the midsole from a foam material; and;

bonding the peripheral component to the main body of the midsole.

7. The method for manufacturing a midsole in accordance with claim 6, wherein the thin sheet is made from thermoplastic polyurethane (TPU).

8. The method for manufacturing a midsole in accordance with claim 6, wherein the thin sheet is made from ethylene vinyl acetate (EVA).

9. The method for manufacturing a midsole in accordance with claim 6, wherein the foam material is directly poured into the receiving space and combined integrally with the shell.

10. The method for manufacturing a midsole in accordance with claim 6, wherein the main body is made from polyurethane (PU).

* * * * *